US005125121A

United States Patent [19]

Wroble

[11] Patent Number: 5,125,121

[45] Date of Patent: Jun. 30, 1992

[54] CUSHION PROTECTION SYSTEM FOR THE INCONTINENT

[76] Inventor: Ida B. Wroble, 883 Mid Burnt Fork, Stevensville, Mont. 59870

[21] Appl. No.: 757,198

[22] Filed: Sep. 10, 1991

[51] Int. Cl.[5] ..... A47G 9/04

[52] U.S. Cl. ..... 5/484; 5/485; 5/499; 5/922; 297/219

[58] Field of Search ..... 5/484, 482, 485, 496, 5/498, 499, 500, 502; 297/219, 218

[56] References Cited

U.S. PATENT DOCUMENTS

| | | | |
|---|---|---|---|
| 1,741,838 | 12/1929 | Gilbert | 5/484 |
| 1,930,398 | 10/1933 | Souchard | 5/484 |
| 1,970,754 | 8/1934 | Donasen | 5/484 |
| 2,414,927 | 1/1947 | Chapman . | |
| 2,468,587 | 4/1949 | Chase et al. | 297/223 |
| 2,614,273 | 10/1952 | Yancofski | 5/473 |
| 2,620,494 | 12/1952 | Kay | 5/473 |
| 2,803,836 | 8/1957 | Hunsicker | 5/484 |
| 3,199,916 | 8/1965 | Chiarenza | 297/223 |
| 3,528,421 | 9/1970 | Vaillancourt et al. | 5/484 |
| 3,576,039 | 4/1971 | Roberts | 5/484 |
| 3,763,907 | 10/1973 | Hockley et al. | 5/484 |
| 3,871,037 | 3/1975 | Willington | 5/484 |
| 4,064,577 | 12/1977 | Walters | 5/484 |
| 4,391,010 | 7/1983 | Kronman | 5/484 |
| 4,445,242 | 5/1984 | Bowen | 5/484 |
| 4,599,756 | 7/1986 | Koffler | 5/484 |

FOREIGN PATENT DOCUMENTS

| | | | |
|---|---|---|---|
| 403237 | 10/1909 | France | 5/484 |

*Primary Examiner*—Alexander Grosz
*Attorney, Agent, or Firm*—Wells, St. John & Roberts

[57] ABSTRACT

A cushion protection system for incontinent individuals is disclosed, including a moisture impervious flexible base sheet. The sheet includes a raised panel extending about the side edges and projecting above a top seating surface thereof such that moisture is not permitted to seep through the sheet. Attachment provisions allow securement of the base sheet to a seating device. A moisture absorbent pad is provided with fasteners that will facilitate secure yet releasable attachment of the pad to the flexible base sheet. The pad may be provided of washable, reusable material, or may be supplied as disposable units, formed of absorbent material.

17 Claims, 1 Drawing Sheet

CUSHION PROTECTION SYSTEM FOR THE INCONTINENT

TECHNICAL FIELD

The present invention relates to a system for placement between a seated individual and a support such as a chair, by which moisture is prevented from being transmitted from the seated individual to the support.

BACKGROUND OF THE INVENTION

Incontinent individuals suffer extreme embarrassment and humility from their infirmity, and as a result will often refuse to leave their immediate surroundings. This is unfortunate since many of such individuals are otherwise able to move about at will and live normal lives. Elderly, who often suffer from incontinence, will often pass up opportunities to live a much more enjoyable, full life because of insecure feelings that they will "have an accident", or others will be hesitant with hospitality for fear their furniture will become soiled.

As a solution, various forms of "diapers" have been developed. These are expensive, not easy to use, uncomfortable, and fail frequently enough to cause mistrust by users. Failure is possible especially when the user is in a sitting position, as leaks are more likely to occur when the absorbent pads are under the compressive weight of the wearer.

Another solution is catheterization. However a catheter is uncomfortable, is often painful to have installed, and requires a collection bag which must be carefully watched and is usually visible, therefore further inducing insecurity.

Given the above problems, it becomes clear that there is a need for a system by which an incontinent person is able to sit confidently without worry that the seating surface will become soiled, and in which such system will be portable and adaptable to many different seating arrangements and is quick and easy to change.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
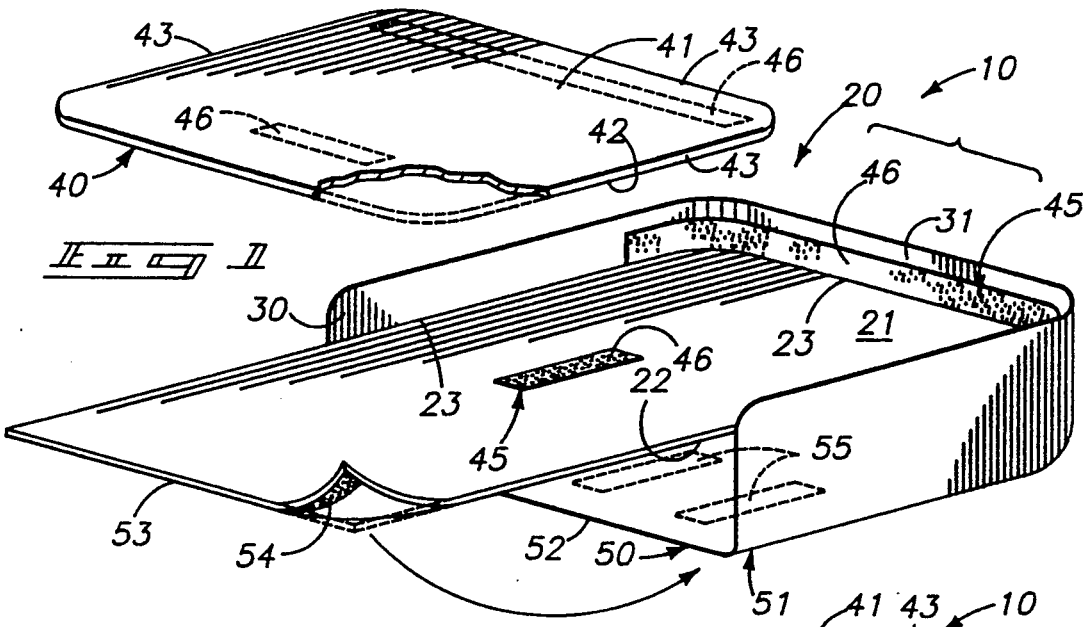
FIG. 1 is a partially fragmented perspective view of a first preferred form of the present invention.
Figure 3:
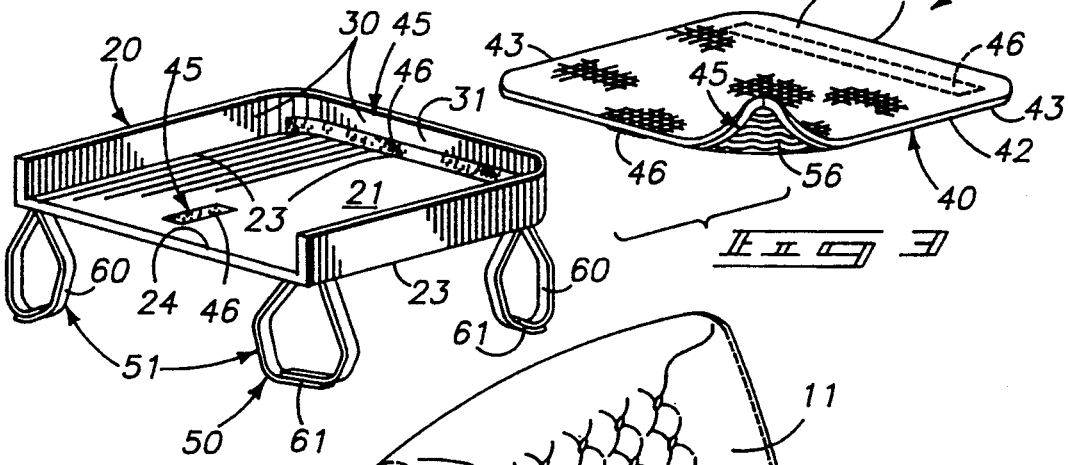
FIG. 3 is a partially fragmented perspective view of a second preferred form of the present invention.
Figure 4:
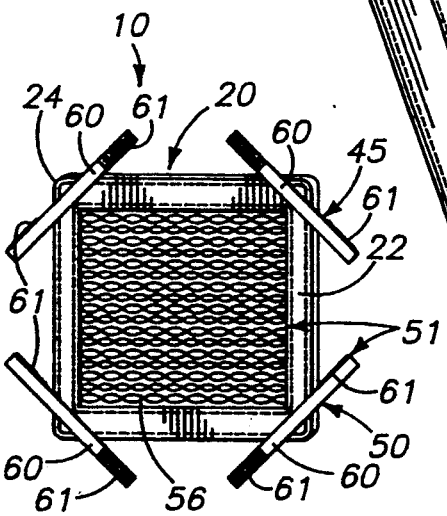
FIG. 4 is a bottom view of the base sheet of the second preferred form.
Figure 2:
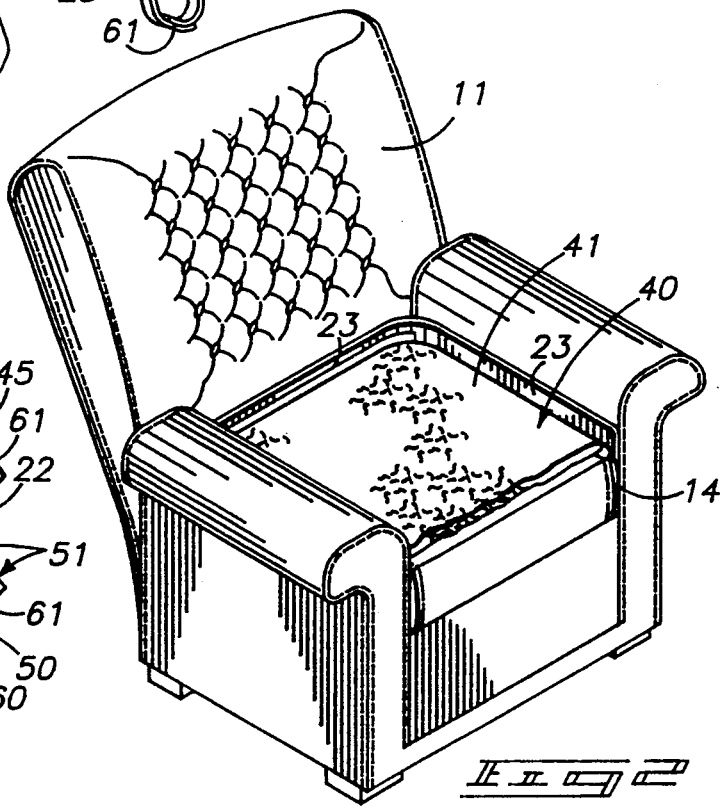
FIG. 2 is a perspective view of the first preferred form shown mounted to a chair.

A cushion protection system is shown at 10 in the accompanying drawings, embodied in two exemplary preferred forms. A first preferred form is shown in FIGS. 1 and 2, while a second preferred form is shown in FIGS. 3 and 4. Both forms include common features and will be described below with like reference numerals used to designate similar features of both. Where differences occur, different descriptions. will be made, along with different reference numerals.

The present system is intended for use by incontinent individuals to give assurance that moisture will not be transmitted to supporting furniture or other forms of support surfaces. To this end, the various preferred forms of the present system are provided to accommodate different seating conditions. For example, the embodiment illustrated in FIGS. 1 and 2 is used for an upholstered chair 11 or the like, having a removable seat cushion 14. The embodiment illustrated in FIGS. 3 and 4 is used for seating where removable cushions may not be available, such as vehicle seats, wheel chairs theater seats, dining chairs, forms of sofas, etc.

In general terms, the present system includes a flexible base sheet 20 having a moisture impervious top seating surface 21 on one side thereof and a bottom surface 22 extending to side edges 23 and a front edge 24.

The base sheet 20 further includes a raised panel 30 extending about the side edges 23 and projecting above the top seating surface 21. The raised panel 30 includes an inwardly facing moisture impervious wall surface 31 is joined with the moisture impervious top seating surface 21 to prevent moisture from seeping through to the seating device below. The base sheet 20, including the top seating surface 21 and the raised panel 30 may be formed of an appropriate water impervious, flexible, and washable material such as a vinyl, commonly available on the marketplace.

A moisture absorbent pad 40 is provided in all embodiments of the invention. The pad includes a top absorbent surface 41 formed of a breathable, absorbent material and a bottom surface 42 extending between pad side edges 43. The side edges define a configuration complimentary to the top seating surface 21 of the base sheet, to removably rest thereon with the pad side edges inwardly adjacent respective side panels of the base sheet.

It is noted that the pad may be formed entirely of an absorbent material. Such material may be selected from any of many available absorbent materials that are commercially available. Such materials are selected in a reusable form, of durable and washable material such as cotton or commercially available absorbent synthetic products. The pad may also be disposable using disposable materials similar to those used in "Depend" TM brand underpads produced by Kimberly Clark Corp. of Neehah, Wisconsin 54956, where it is desirable that the pads simply be replaced after use.

A pad attachment means 45 is provided in the preferred forms for releasably securing the pad 40 to the base sheet 20. The pad attachment means is advantageously situated on the bottom surface 42 of the pad and the top seating surface 21 of the base sheet for releasably securing the pad to the top seating surface of the base sheet.

In a first preferred form, the pad attachment means is provided in the form of hook and loop fastener members mounted to the pad 40 and to the base sheet 20. When the pad is placed on the base sheet, the hooks and loops will releasably join and secure the pad in place. The fasteners are advantageously formed of washable fabric of a commercially available type such as "Velcro" TM brand fasteners. Similar fastener materials may also be used for the base sheet attachment means 50 to be described below.

The pad attachment means 45, in an alternate preferred form (FIG. 3) may include a non-slip material 56 for engagement with the top surface of the base sheet. The non-skid surface may be a commercially available material such as "Slipnot" TM, or "Wicker-loc" TM surfaces distributed by Vantage Industries, Inc. of 4530-F Patton Drive East, Atlanta Ga. 30336. This type of surface assists secure attachment of the pad 40 to the top seating surface of the base sheet 20, yet allows removal of the pad for cleaning purposes. Fasteners 46 and non-skid surface material 56 may be used together as shown in FIG. 3.

The pad and other components may also be treated with a deodorizer and disinfectant, if so desired.

An attachment means generally shown at 50 for the preferred embodiments is provided for releasably securing the base sheet 20 to a seating device. Means 50 varies between the preferred embodiments exemplified herein, but in all preferred embodiments, includes a seating device engaging means 51 thereon for securing the base sheet 20 to the seating device against movement thereon.

FIG. 1 shows the attachment means as a pocket 52 on the base sheet bottom surface 22 for receiving the seating device cushion 14 (FIG. 2). The pocket 52 may be formed integrally with the moisture impervious material of the base sheet. If advantageously includes a forward flap 53 foldable over the open end of the pocket 52 to protectively cover the forward surfaces of the cushion 14 and to assist in securing the base sheet 20 to the cushion. To this end, conventional fabric hook and loop fastener members 54, 55 are provided on the flap 53 and on the bottom surface of the pocket 52.

The fastener members 55 are provided in multiple strips spaced apart to facilitate adjustments for different size seat cushions. It is noted, though, that the members 54 could as easily be provided in strips on the flap 53.

FIGS. 3 and 4 show the seating device engagement means 51 as a non-skid surface 56 thereon for securing the base sheet to the seating device against movement thereon. The non-skid surface may be a the same commercially available material such as "Slipnot" TM, or "Wicker-loc" TM surfaces described above. This type of surface assists secure attachment of the base sheet to the support surface below.

FIGS. 4 and 3 also show the seating device engagement means 51 as straps 60 on the base sheet with washable hook and loop fasteners 61 (similar to those described above) to be selectively joined about at least a portion of the seating device 11 to further secure the base sheet 20 to the seating device 11 against movement thereon. The straps 60 can be used to supplement the non-skid surface 56 as shown in FIG. 4, or the straps 60 may be used alone.

Operation of the present invention is preceded by installation. The first preferred form of the invention utilizing the pocket 52 is secured to a seat cushion by simply sliding the pocket 52 over the cushion. Next, the flap is secured in place over the forward part of the cushion using the hook and loop strips 54, 55. The pad 40 is then placed on the top seating surface 21 and is attached with the pad attachment means 45 by contacting the fasteners 46 of the pad 40 and base sheet 20. The system is now ready for use to seat an individual in position on the pad. Should the individual urinate while seated on the pad, moisture will be absorbed by the pad and the base sheet will prevent such moisture from reaching the seat surface below. The pad attachment means functions during this time to assure that the pad will not slide off the base sheet.

If pad becomes oversaturated, the raised side panel 30 will prevent spillage over the side edges of the sheet and onto the seat surface below.

Once used, the system maybe easily disassembled for cleaning and re-use. This is done simply by reversing the steps recited above for mounting the system to the seating device 11. Alternatively, if the pad is formed of disposable materials, the entire pad 40 may be disposed of and replaced with a fresh one for subsequent use. The base sheet may remain on the seating device and simply be wiped clean and re-used.

Operation of the second preferred embodiment is substantially the same as described above with the exception that the procedure for attaching the base sheet is accomplished by use of the straps 60, the non-skid surface 56 or both. The non-skid surface 56 will assist by engaging the seat in a high friction manner. The straps 60 are secured by wrapping about corners of the seat or other adjacent parts of the seat and attachment of the strap fasteners 61 to secure the base sheet in place.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A cushion protection system for attachment to chairs or the like having a seat cushion, the protection system adapted to substantially cover at least the top surface of the seat cushion, comprising:

a flexible base sheet having a moisture impervious top seating surface on one side thereof and a bottom surface extending to side edges and a front edge;

the flexible base sheet including a raised panel extending about the side edges and projecting above the top seating surface, said raised panel including an inwardly facing moisture impervious wall surface joined with the moisture impervious top seating surface of the flexible sheet such that moisture is not permitted to seep through the sheet or raised panel;

attachment means for releasably securing the base sheet to the seat cushion, said attachment means contacting at least portions of the sides and bottom of the seat cushion; and a moisture absorbent pad having a top absorbent surface and a bottom surface extending between pad side edges defining a configuration complimentary to the top seating surface of the base sheet, with the pad side edges inwardly adjacent respective side panels of the base sheet.

2. A cushion protection system, as claimed in claim 1 wherein the bottom surface of the pad includes a non-slip material thereon for engagement with the top surface of the base sheet.

3. A cushion protection system, as claimed in claim 1 wherein the pad includes a pad attachment means for releasably securing the pad to the base sheet.

4. A cushion protection system, as claimed in claim wherein the pad and base sheet include a pad attachment means on the bottom surface of the pad and the top seating surface of the base sheet for releasably securing the pad to the top seating surface of the base sheet.

5. A cushion protection system, as claimed in claim 1 wherein the pad includes a pad attachment means and wherein the pad is formed of disposable material.

6. A cushion protection system as claimed by claim 1 wherein the pad includes a pad attachment means and wherein the pad is formed of washable, reusable material.

7. A cushion protection system, as claimed in claim 1 wherein the attachment means is on the base sheet and is comprised of seat cushion engaging means thereon for securing the base sheet to the seat cushion against movement thereon.

8. A cushion protection system, as claimed in claim 1 wherein the attachment means is comprised of a pocket on the base sheet bottom surface for receiving the seat cushion.

9. A cushion protection system, as claimed in claim 1 wherein the attachment means is comprised of a pocket on the base sheet bottom surface for receiving the seat cushion; and further comprising a flap on the base sheet foldable over the pocket to cover the seat cushion received therein.

10. A cushion protection system, as claimed in claim 1 wherein the attachment means is on the base sheet and is comprised of a non-skid surface thereon for securing the base sheet to the seat cushion against movement thereon.

11. A cushion protection systems, as claimed in claim 1 wherein the attachment means is on the base sheet and is comprised of a non-skid surface thereon for securing the base sheet to the seat cushion against movement thereon and straps on the base sheet with fasteners to be selectively joined about at least a portion of the seat cushion to further secure the base sheet to the seat cushion against movement thereon.

12. a cushion protection system, as claimed in claim 1 wherein the attachment means is on the base sheet and is comprised of a straps with fasteners thereon extendible about at least a portion of the seat cushion, for securing the base sheet to the seat cushion against movement thereon.

13. A cushion protection system, as claimed in claim 1 wherein the attachment means is comprised of:

a pocket on the base sheet bottom surface for receiving the seat cushion;

a flap on the base sheet foldable over the pocket to cover the seat cushion received therein; and flap attachment means on the pocket and flap for securing the flap in engagement with the pocket.

14. A cushion protection system, as claimed in claim 1 wherein the pad includes a pad cover of absorbent material and an absorbent filler within the pad cover.

15. A cushion protection system, as claimed in claim 1 wherein the pad includes a pad cover of absorbent material and an absorbent filler within the pad cover; and wherein the pad cover includes a non-slip surface for engaging the top seat surface of a the base sheet.

16. A cushion protection system, as claimed in claim 1 wherein the pad includes a non-slip surface for engaging the top seat surface of the base sheet; and first and second pad attachment members formed of washable fabric hook and eye fastening material, with one of the pad attachment members on the pad and the remaining attachment member mounted to the base sheet for selectively engaging and releasably locking with the one member.

17. A cushion protection system, as claimed in claim 1 wherein the base sheet and raised panel are integral and wherein the raised panel extends to ends adjacent the front edge of the base sheet.

* * * * *